US006841074B2

(12) United States Patent
Möbius et al.

(10) Patent No.: US 6,841,074 B2
(45) Date of Patent: Jan. 11, 2005

(54) METHOD AND APPARATUS OF PURIFYING AN ELECTROLYTE

(75) Inventors: Andreas Möbius, Kaarst (DE); Axel König, Herzogenaurach (DE)

(73) Assignee: Enthone-OMI (Deutschland) GmbH, Solingen (DE)

( * ) Notice: Subject to any disclaimer, the term of this patent is extended or adjusted under 35 U.S.C. 154(b) by 332 days.

(21) Appl. No.: 09/939,502

(22) Filed: Aug. 24, 2001

(65) Prior Publication Data

US 2002/0029974 A1 Mar. 14, 2002

(30) Foreign Application Priority Data

Aug. 29, 2000 (EP) ..... 00118640

(51) Int. Cl.[7] ..... B01D 61/00

(52) U.S. Cl. ..... 210/641; 210/644; 210/649; 210/650; 210/669; 210/774; 210/806

(58) Field of Search ..... 210/96.1, 96.2, 210/97, 137, 143, 149, 167, 194, 195.1, 195.2, 257.1, 257.2, 258, 259, 321.65, 321.89, 321.9, 500.23, 637, 639, 641, 644, 649–651, 702, 739, 749, 774, 806, 742, 480–482, 669

(56) References Cited

U.S. PATENT DOCUMENTS 3,454,490 A * 7/1969 Wallace ..... 210/638
3,663,403 A * 5/1972 Christenson et al. ..... 204/481
4,357,220 A * 11/1982 Eisenmann ..... 210/644
4,563,337 A * 1/1986 Kim ..... 423/24
5,064,538 A * 11/1991 Boeteng ..... 210/638
5,320,816 A * 6/1994 Tsai et al. ..... 423/235
5,382,365 A * 1/1995 Deblay ..... 210/644
5,430,224 A * 7/1995 Schucker ..... 585/818
5,562,828 A * 10/1996 Olsen et al. ..... 210/638
5,637,224 A * 6/1997 Sirkar et al. ..... 210/644
6,264,809 B1 * 7/2001 Lee ..... 204/282
6,379,517 B1 * 4/2002 Heydecke et al. ..... 204/522
6,436,213 B1 * 8/2002 Hopkins ..... 156/73.1

FOREIGN PATENT DOCUMENTS

JP 62247099 10/1987
JP 05059599 9/1993

* cited by examiner

*Primary Examiner*—Joseph Drodge
(74) *Attorney, Agent, or Firm*—Senniger Powers

(57) ABSTRACT

A method of purifying an electrolyte by bringing the electrolyte into contact with a first effective surface of a separating unit that is permeable to contaminants to be removed from the electrolyte, and bringing a purifying liquid into contact with a second effective surface of the separating unit. A concentration level of contaminants in the purifying liquid is maintained to maintain a contaminant driving force gradient between the electrolyte and the purifying liquid so contaminants transfer from the electrolyte into the purifying liquid. An apparatus for purifying an electrolyte having a first volumetric region for holding the electrolyte, a second volumetric region for holding a purifying liquid, and a separating unit that is permeable to the contaminants to be removed from the electrolyte and which fluidically separates the first and second volumetric regions.

31 Claims, 1 Drawing Sheet

METHOD AND APPARATUS OF PURIFYING AN ELECTROLYTE

BACKGROUND OF THE INVENTION

The subject matter of this invention relates to a method of purifying an electrolyte and an apparatus for carrying out the method.

The electrolytic deposition of metals from dissociated solutions of their salts has long been known in prior art and is used in many practical applications. In the metal solutions known as electrolytes, the salts are present in their dissociated form as ions. As a rule, electrolytes can be aqueous or organometallic systems as well as molten salts; apart from the aluminum deposition from organic electrolytes, aqueous electrolytes in particular are preferably used in electroplating and electroforming technology.

Ions are electrically charged atoms or groups of atoms which, due to their electrical charge, are able to conduct current. The electrical conductivity of the electrolytes can be further improved by the addition of acids or alkalis and/or salts thereof.

Prior to the step of the actual electrolytic metal coating procedure, it is generally necessary to subject the substrates that are to be coated to different preliminary treatments. These include, for example, degreasing, pickling, conditioning, and in the case of nonconducting substances, the deposition of conducting base layers. To carry out these preparatory steps, as a rule chemical baths are used into which the substrates to be coated are immersed. Although each of these preparatory steps is generally followed by an appropriate rinsing cycle to clean the substrate, it is not possible to completely prevent a transfer of undesirable chemicals into the electrolyte so that the electrolyte is unintentionally contaminated.

The quality of a metal film produced by electrolytic metal deposition depends decisively on the composition of the electrolyte. Thus, the goal has been to avoid a contamination of the electrolyte and thus a change in the composition of the electrolyte. However, since a transfer of the chemicals used in the previously carried out processing steps cannot be effectively avoided, the degree of contamination gradually increases over the lifetime of the electrolyte. Once a specific concentration of contaminants has been exceeded, the electrolyte is no longer serviceable and must be replaced.

One added disadvantage is that as the degree of contamination of the electrolyte increases, the probability that contaminants present in the electrolytes will be unintentionally absorbed by or incorporated into the lattice structure of the precipitating metal film, which eventually leads to the formation of defective metal films. To avoid this, it is necessary to replace a contaminated electrolyte early on with a new electrolyte which does not contain any contaminants. Against the background of environmentally benign disposal considerations, this is in most cases extremely time-consuming and, last but not least, very expensive.

An additional contamination of the electrolyte takes place during the electroless metal deposition. Thus, for example, during the ion exchange process, the ion exchange causes the nobler metal to be deposited on the less noble metal which then in turn goes into solution as an ion. In the end effect, this means that the ion concentration of the less noble metal in the electrolyte increases as the length of time during which the metal deposition process is carried out increases. Such electrolytes can be reused only to a limited extent since the serviceability of the electrolyte is compromised once a specific ion concentration has been exceeded so that the electrolyte has to be exchanged for a new one. In addition, as the ion concentration in the electrolyte increases, the insertion defect rate increases; furthermore, in the course of the deposition of the nobler metal, ions of the less noble metal can be entrained and inserted in an undesirable manner into the metal lattice structure. Thus, the following rule applies: The higher the concentration of foreign ions, the higher will be the fault insertion rate. Thus, to ensure that electroless metal deposition consistently leads to a uniform high quality, the electrolyte must be continuously monitored for the foreign ion concentration and must be replaced as soon as a predeterminable maximum concentration is exceeded. But the replacement of a contaminated electrolyte with a new electrolyte is a disadvantage not only when viewed against the background of environmentally benign disposal considerations but also because the valuable raw materials in the form of the metal ions that are dissolved in the electrolyte are wasted.

Another drawback is that electroplating baths as well as electroless baths contain inorganic and organic additives. These substances are modified and decomposed as a function of time and action (i.e., as a function of the current density, the potential or the temperature). Thus, both the quantity of the components as well as the chemical composition thereof can change. The decomposition and conversion products interfere with the electrodeposition and the electroless deposition. Therefore, these substances must be removed from the baths.

SUMMARY OF THE INVENTION

Based on the above, the problem to be solved by the present invention therefore is to make available a method of purifying an electrolyte which does not have the disadvantages mentioned above and which, in particular, makes it possible to reuse the electrolyte, thus meeting the requirement of an environmentally benign use of valuable resources, and which maintains the composition of the electrolyte constant for the duration of the metal deposition cycle, thus meeting the requirement of a uniformly high-quality deposition. In addition, this invention also provides a suitable device for carrying out the method.

To solve this problem, the present invention proposes a method of purifying an electrolyte, in which the electrolyte is brought into contact with an effective surface of a separating unit that is permeable to the contaminants to be removed from the electrolyte, and of making available a purifying liquid which is brought into contact with a second effective surface of the separating unit while ensuring that the concentration of contaminants in the purifying liquid is maintained constant for the duration of the purification step in order to maintain a driving force gradient between the electrolyte and the purifying liquid so as to make possible the transfer of the contaminants from the electrolyte into the purifying liquid.

Briefly, therefore, the invention is directed to a method of purifying an electrolyte involving bringing the electrolyte into contact with a first effective surface of a separating unit that is permeable to contaminants to be removed from the electrolyte, bringing a purifying liquid into contact with a second effective surface of the separating unit, and maintaining a concentration level of contaminants in the purification liquid which concentration level maintains a contaminant driving force gradient between the electrolyte and the purifying liquid so contaminants transfer from the electrolyte into the purifying liquid.

The invention is also directed to a method of purifying an electrolyte involving bringing the electrolyte into contact with a first effective surface of a separating unit that is permeable to contaminants to be removed from the electrolyte, bringing a purifying liquid into contact with a second effective surface of the separating unit, circulating the electrolyte and the purifying liquid in circuits that are fluidically independent of each other, maintaining a concentration level of contaminants in the purifying liquid below a preselected level to maintain a contaminant driving force gradient between the electrolyte and the purifying liquid so contaminants transfer from the electrolyte into the purifying liquid, and removing contaminants from the purifying liquid by a method selected from among chemically binding and precipitating contaminants, filtering, distillation, membrane distillation, freezing, absorption, and ion exchange.

The invention is further directed to a method of purifying an electrolyte involving bringing the electrolyte into contact with a first effective surface of a separating unit that is permeable to contaminants to be removed from the electrolyte, bringing a purifying liquid into contact with a second effective surface of the separating unit, circulating the electrolyte and the purifying liquid in circuits that are fluidically independent of each other, and maintaining a concentration level of contaminants in the purifying liquid below a preselected level by in-process dilution to maintain a contaminant driving force gradient between the electrolyte and the purifying liquid so contaminants transfer from the electrolyte into the purifying liquid.

In another aspect the invention is directed to an apparatus for purifying an electrolyte, the apparatus having a first volumetric region for holding the electrolyte, a second volumetric region for holding a purifying liquid, and a separating unit that is permeable to the contaminants to be removed from the electrolyte and which fluidically separates the first and second volumetric regions.

Other objects and features of the invention will be in part apparent and in part pointed out hereinafter.

DETAILED DESCRIPTION OF THE PREFERRED EMBODIMENT

Figure 1:
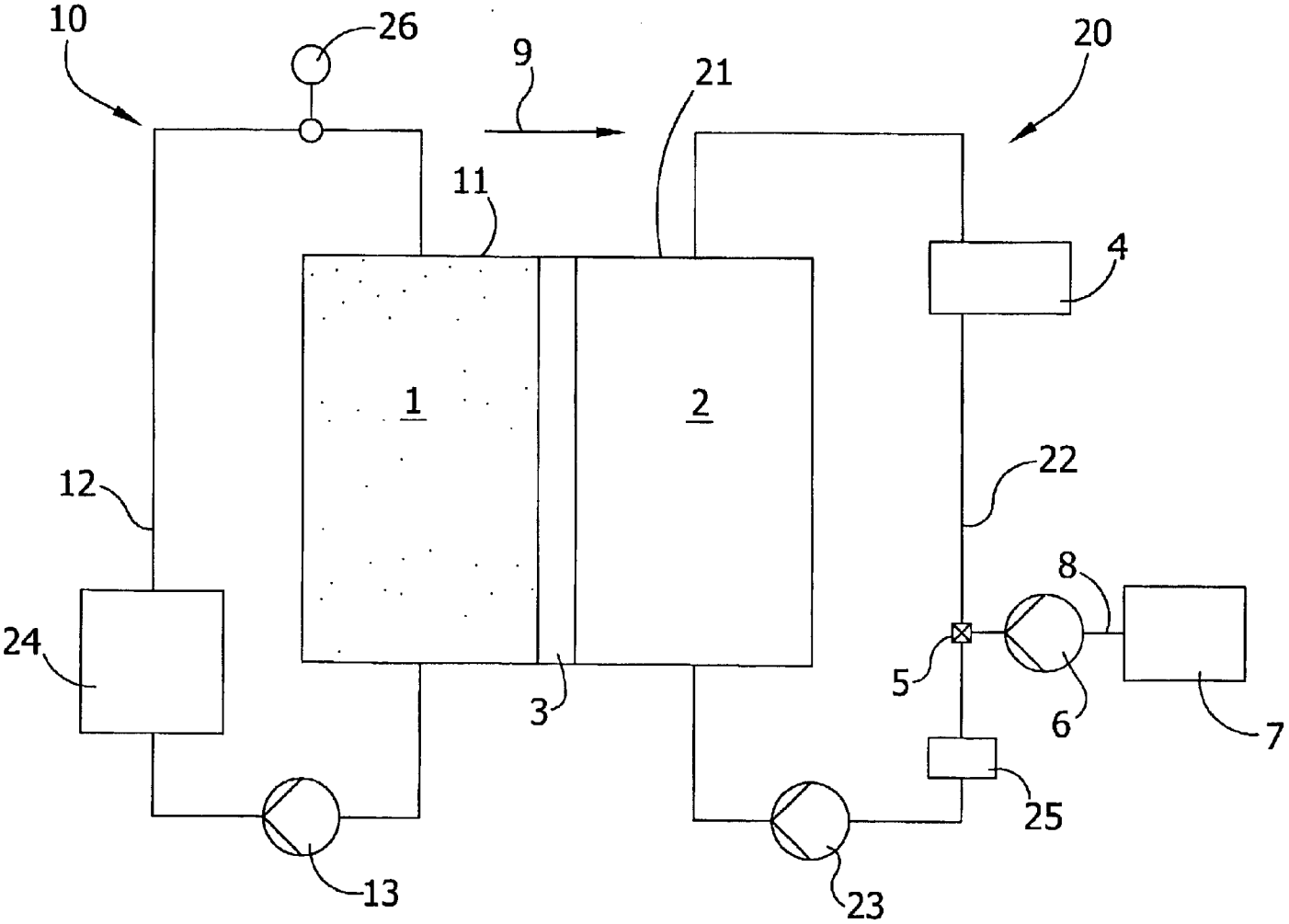
FIG. 1 is a schematic representation of the method of the invention.

The basic idea of the present invention is to free the contaminated electrolyte from contaminants by using a suitable purifying liquid and thus to make available a reusable electrolyte in an environmentally benign manner. The purification of the electrolyte can be carried out either continuously, i.e., during the metal deposition cycle, or after conclusion of the metal deposition in a separate recycling step. The advantage in both cases is that the purification method according to the present invention can be readily integrated into already existing operating cycles and that the contaminated electrolyte can be purified in an inexpensive and, in particular, environmentally benign manner.

This method provides that the electrolyte be brought into contact with an effective surface of a separating unit. This separating unit can be permeated by those contaminants that must be removed from the electrolyte. Such contaminants include, for example, ions originating in upstream processing steps, such as foreign metal ions or ions from halogens, or molecules, such as polymer molecules, or cleavage and decomposition products of organic and inorganic additives.

This method also makes available a purifying liquid, such as water or another water-based liquid, which is brought into contact with another effective surface of the same separating unit. Thus, the electrolyte to be purified and the purifying liquid are not in fluidic contact with each other; yet, the permeable separating unit makes it possible for contaminants to be transferred from one side of the separating wall to the other side of the separating wall. To ensure that a transfer of the contaminants from the electrolyte into the purifying liquid takes place, the present invention proposes that in order to maintain a driving force gradient between the electrolyte and the purifying liquid, the concentration of contaminants in the purifying liquid, at least for the duration of the purifying procedure, be kept at a slightly lower level than that of the electrolyte.

In the context of this invention, the driving force gradient is defined as the gradient of the chemical or electrochemical potential.

Due to the prevailing driving force or potential gradient between the electrolyte and the purifying liquid, contaminants present in the electrolyte are made to diffuse through the separating unit into the purifying liquid. It may be provided that transfer of the contaminants from the electrolyte into the purifying liquid can thus no longer take place only once the driving force gradient is zero, i.e., once the chemical potential in the electrolyte is identical to that in the purifying liquid. Thus, when the concentration of contaminants in the purifying liquid is kept lower than that in the electrolyte, a concentration gradient from the electrolyte into the direction of the purifying liquid prevails, and a transfer of the contaminants from the electrolyte into the purifying liquid takes place.

It is also possible to make the purifying liquid as well as the separating unit selective, i.e., to introduce substances into the purifying liquid or to incorporate substances into the separating unit, which substances have the effect of transporting contaminants from the electrolyte via the separating unit into the purifying liquid even counter to an existing potential gradient.

The method according to the present invention makes it possible to purify an electrolyte in a simple and efficient manner, thus making it possible to profitably recycle and thus to reuse the electrolyte. In addition, the method according to the present invention makes it possible for the duration of a metal deposition cycle to maintain the composition of the electrolyte constant, thus ensuring that a reproducible high-quality metal deposition is obtained.

According to one characteristic of this invention, the concentration of contaminants in the purifying liquid is kept below a predeterminable desired concentration. This ensures a uniform high-quality metal deposition outcome. In addition, by stipulating a desired concentration limit that cannot be exceeded, a measuring specification is provided which can be monitored by means of measuring technology. Thus, for example, it is possible for an arrangement to be made so that as soon as a predeterminable desired concentration is exceed, a warning signal is triggered, which signal calls attention to the fact that the concentration of contaminants in the purifying liquid is too high, thus no longer ensuring that the purification of the electrolyte continues to be effective. This ensures that the purifying liquid is replaced early on and that the metal deposition result in the electrolyte is not impaired due to a reduced purifying action.

According to another characteristic of this invention, the purifying liquid is diluted and/or regenerated during the course of the purifying step. This simple measure makes it possible to reduce the concentration of contaminants in the purifying liquid, with the ratio between dilution and reduction of the concentration being proportional. The purification can be carried out continuously or batchwise as well as in a closed circuit.

According to yet another characteristic of this invention, it is possible to remove the contaminants from the purifying liquid. Thus, for example, the purifying liquid can be distilled off or recovered in pure form by means of another method. This is useful in that it makes it possible, on the one hand, to reduce the concentration of contaminants in the purifying liquid while maintaining the purifying liquid at a constant volume and, on the other hand, to reuse the purifying liquid by removing the contaminants. This approach is especially useful when an electrolyte for electroless metal deposition is used where the contaminants stem from the metal ions of the less noble metal, which ions were dissolved in the electrolyte.

According to a special proposal of the present invention, the contaminants are removed from the purifying liquid by chemically binding the contaminants and subsequently precipitating them from the purifying liquid. Thus, depending on the contaminant that is to be precipitated, it is possible to add suitable ions to the purifying liquid, which ions chemically bind the contaminants that are to be removed from the purifying liquid, thus offering the possibility of an easy separation, for example, by means of precipitation. Or the contaminants can be removed from the purifying liquid by means of filters, or the purifying liquid itself can be recovered in pure form. This can be carried out, for example, by distillation, membrane distillation, or freezing.

According to another characteristic of the present invention, the electrolyte and/or the purifying liquid are/is moved relative to the respective effective surface of the separating unit. As a result, the purifying action of the separating unit is increased. This is due to the fact that immediately after a transfer, contaminants diffused from the electrolyte into the purifying liquid are moved away from the effective surface of the separating unit so that the highest possible driving force or potential gradient is maintained in the immediate vicinity of the separating unit.

Furthermore, according to yet another characteristic of the present invention, the fluidically independent systems of the electrolyte and the purifying liquid can be circulated in circuits having opposite directions of flow. This measure also contributes to maintaining the highest possible driving force gradient in the immediate vicinity of the separating unit.

According to yet another characteristic of the present invention, the intensive variables of state of the electrolyte and/or the purifying liquid are varied over the duration of the purifying step as a function of the degree of purification desired. Intensive variables of state include, for example, especially the pressure and the temperature.

As to the equipment to be used to implement this invention, the present invention proposes a device characterized by two volumetric regions which are fluidically separated from each other by means of a separating unit that is permeable to the contaminants to be removed from the electrolyte, with one of the volumetric regions serving to hold the electrolyte to be purified and the other volumetric region serving to hold the purifying liquid.

To carry out the method according to the present invention, the proposed device is substantially characterized by two volumetric regions which are fluidically separated from each other by means of a separating unit. As already explained above, the separating unit is permeable to those contaminants that are to be removed from the electrolyte. One of the volumetric regions serves to hold the electrolyte while the other volumetric region serves to hold the purifying liquid. Thus, the volumetric regions are arranged next to each other and are fluidically separated by means of a separating unit, thus ensuring that the electrolyte and the purifying liquid cannot mix.

According to a first proposal of this invention, the separating unit of the device is designed so as to be porous or impermeable to liquid. The structure of the separating unit is designed to ensure that, due to the existing driving force gradient, only the contaminants can diffuse out of the electrolyte through the separating unit into the purifying liquid. An example of a porous separating unit is a graphite foam material which is cured like a sponge. But other materials, such as PP, PE, ceramics, metals, or other suitable materials, can also be used. Also, to produce a separating unit that is impermeable to liquid, combinations of porous and nonporous materials or materials with a different structure can be used.

According to a special characteristic of this invention, the separating unit is a membrane module, e.g., in the form of a hollow fiber membrane, a capillary membrane, or flat sheet membrane. It is formed by a plurality of separating elements that are arranged next to one another and allows the passage of contaminants as a function of the effective surface of the membrane and/or of the membrane thickness. In other words: The permeating mass flow rate can be determined by the design of the separating elements of the membrane module.

According to yet another characteristic of the present invention, the walls enclosing the volumetric region of the electrolyte are made of an inert material. This is useful in that it ensures that literally all of the contaminants to be removed from the electrolyte are actually transported into the purifying liquid and do not adhere in an undesirable manner to the walls that enclose the volumetric region of the electrolyte. In addition, it is ensured that the electrolyte as such does not react with the material of which the wall is made, thus preventing the formation of undesirable contaminants.

According to yet another characteristic of the present invention, the volumetric regions are containers for holding material. As already described earlier, one of the containers serves to hold the electrolyte and the other container serves to hold the purifying liquid. Instead of a container that is shaped, e.g., in the form of a tub, the volumetric region can also have a different design, the only prerequisite being that each of the two volumetric regions forms a separate system and that the electrolyte and the purifying liquid are fluidically independent of each other.

According to another characteristic of the present invention, at least one of the volumetric regions is connected to a circulation device. Such a circulation device may be, for example, a stirring rod. This stirring rod mixes the liquid contained in the volumetric region and thus ensures that the concentration of contaminants is uniformly distributed throughout the volumetric region. As an alternative, the circulation device can also be a liquid pump. In contrast to a stirring rod, a liquid pump ensures a uniform movement of flow, the direction of which can be set. If each volumetric region is connected to a separate liquid conveying pump, it can be provided that the electrolyte and the purifying liquid flow past the effective surface of the separating unit either in opposite directions or in the same direction. The special advantage of a circulation device in the form of a pump is that due to the movement of flow, the contaminants that diffused into the purifying liquid are transported away from the immediate vicinity of the effective surface of the separating unit as soon as they have entered the purifying liquid. In this manner, an optimum driving force gradient can be maintained.

According to another characteristic of the present invention, the flow rates in the volumetric regions can be adjusted. Thus, it is possible to set both an optimum concentration distribution and an optimum partial pressure. In addition, it is possible to adjust the removal efficiency of the method according to the present invention by suitably adjusting the intensive variables of state of the electrolyte and/or the purifying liquid.

Additional characteristics and advantages of the present invention follow from the description based on the FIGURE below which is a diagrammatic representation of the method according to the present invention.

The FIGURE shows a volumetric region for the electrolyte 10 and a volumetric region for the purifying liquid 20. These two volumetric systems 10 and 20 are separated by means of a shared separating unit 3.

The volumetric region for the electrolyte 10 comprises a container 11, a liquid conduit 12, and a circulation device in the form of a pump 13, the transport direction of which can be set as desired. Container 11 contains electrolyte 1 which is to be purified.

The volumetric region for the purifying liquid 20 comprises a container 21, a liquid conduit 22, and a circulation device in the form of a pump 23. The transport direction of pump 23 can preferably be freely chosen. Container 21 contains a purifying liquid 2.

Electrolyte 1 and purifying liquid 2 are fluidically independent of each other. Separating unit 3 is permeable to the contaminants that are to be removed from the electrolyte and can be designed, for example, as a hollow fiber membrane. Via pumps 13 and 23, electrolyte 1, on the one hand, and purifying liquid 2, on the other hand, are kept moving, with the possibility of providing that each flows past separating unit 3 in a direction opposite to the other or that both flow past said unit in the same direction.

In the FIGURE, the contaminants present in electrolyte 1 are designated by dots. As the FIGURE clearly shows, in the case illustrated, contaminants are present solely in the electrolyte but not in the purifying liquid. Thus, in the case illustrated by the FIGURE, the contaminant concentration gradient between the electrolyte and the purifying liquid assumes a maximum value. Due to this driving force gradient, the contaminants contained in electrolyte 1 are driven to diffuse through the permeable separating unit 3 into purifying liquid 2. Conversely, this means that the driving force or potential gradient is zero whenever the contaminant concentration in electrolyte 1 is identical to the contaminant concentration in purifying liquid 2. When this point is reached, the purification of the electrolyte can no longer continue.

According to this invention, it is provided that for the duration of the purifying cycle, the concentration of contaminants in purifying liquid 2 be kept at a level lower than that in electrolyte 1, i.e., the driving force gradient is always greater than zero. In this context, it should be mentioned that ensuring that the concentration of contaminants in purifying liquid 2 is kept low can be done on a permanent and continuous basis, i.e., during an electrolytic metal deposition cycle, or, as an alternative, it can be carried out after conclusion of a metal deposition cycle in a separate recycling step.

To maintain the contaminant concentration in purifying liquid 2 at a level lower than that of electrolyte 1, the FIGURE presents two alternatives which can also be used in combination with each other. The first proposal involves a material separating device (decontaminator) 4. Material separating device 4 serves to precipitate the contaminants present in dissolved form, for example, ions, which were transferred from electrolyte 1 into purifying liquid 2, and to remove them from the volumetric region for the purifying liquid 20 or to separate the purifying liquid itself, for example, by means of distillation. This approach has two advantages. First, it makes it possible to reduce the contaminants present in purifying liquid 2 while maintaining a constant volume of purifying liquid, and secondly, the contaminants thus precipitated can be reutilized. This approach can be used, for example, in cases in which electrolyte 1 is used for stripping and in which there is a possibility of recovering valuable metals. Thus, this first approach to the purification aims at either removing the contaminants that formed in the electrolyte from the purifying liquid, which can be accomplished, for example, by means of filters, or at recovering the purifying liquid itself by means of suitable measures, such as distillation. But regardless of which alternative is chosen, it is crucial that the purification is carried out continuously or batchwise and that it can be carried out in a closed circuit, which ensures that the purifying liquid is completely free from contaminants.

An alternative to reducing the concentration of contaminants in purifying liquid 2 is dilution. For this purpose, a reservoir 7 with a diluting medium, for example, water, is provided. This reservoir is connected to liquid conduit 22 by way of conduit 8. Via valve 5, conduit 8 can be closed, and when needed, valve 5 can be opened to transport the diluting medium from reservoir 7 into liquid conduit 22. To transport the diluting medium, a pump 6 is used. This alternative possibility of reducing the concentration can be easily implemented. The degree of dilution is proportionate to the reduction of the concentration.

According to an especially useful embodiment, the two alternatives mentioned above can be used in combination with each other. In this context, for example, the purifying liquid can be continuously diluted, ensuring that the quantity of the diluting medium added corresponds exactly to the contaminated purifying liquid that is drawn off. Using the first alternative, this quantity of contaminated purifying liquid can then preferably be purified in such a way that in the end, purified and reusable purifying liquid is available. This purifying liquid can subsequently be returned to the circuit, with the same quantity of purified liquid being added as contaminated liquid is withdrawn and purified. Combining both alternative approaches of recovering purifying liquid offers the advantage that the purifying liquid that is removed from the circuit can be freed from contaminants outside the circuit while at the same time making it possible to keep the quantity of purifying liquid inside the circuit at a constant level. Thus, it is possible to maintain a uniform contaminant concentration in the purifying liquid, i.e., to ensure that a specific contaminant concentration in the purifying liquid is not exceeded, and at the same time to continuously purify withdrawn purifying liquid, i.e., to free it from undesirable contaminants.

According to an especially useful embodiment of this invention, purifying liquid 2 and/or separating unit 3 can be made to be selective by means of adding suitable substances, i.e., only specific contaminants can be dissolved out of the electrolyte or specific contaminants can also be transported from the electrolyte into the purifying liquid counter to the potential gradient. This measure makes it possible to target and remove highly specific contaminants from the electrolyte, with the removal of the contaminants from the electrolyte also being possible counter to a driving force or potential gradient. The selective material transport can be implemented using different measures. For example, the selectivity of the purifying liquid itself can be adjusted. This can be implemented, for example, by means of complexing or clustering agents. In addition, solvents which target specific contaminants or mixtures of suitable solvents can be added to the purifying liquid. In addition, the intensity of the processing conditions can be varied, which can lead to a selective material transport.

Overall, this method according to the present invention makes it possible for the first time to purify electrolytes and to process them so that they can be reused. The core element of the present invention is to be seen in the fact that the electrolyte is brought into contact with an effective surface of a separating unit which is permeable by the contaminants that are to be removed from the electrolyte. As a result of the concentration gradient between electrolyte 1 and purifying liquid 2 which is brought into contact with the other effective surface of separating unit 3, the contaminants are transferred from electrolyte 1 in the direction of arrow 9 into purifying liquid 2. For the duration of the purifying step, the contaminant concentration in purifying liquid 2 is kept at a level below that of electrolyte 1.

To ensure that the purifying liquid and the electrolyte are always at a constant volumetric ratio with respect to each other, a storage tank 24, on the one hand, and a buffer tank 25, on the other hand, are provided. In this manner, it is ensured that containers 11 and 21 always contain the same quantity of electrolyte 1 and purifying liquid 2, respectively. Furthermore, it was found to be useful to provide a concentration measuring device 26 which measures the concentration of contaminants present in electrolyte 1. The concentration can, of course, also be measured by means of such a device in the purifying liquid circuit. Measuring the concentration makes it possible to accurately adjust the process parameters with respect to actually existing conditions. Thus, for example, to obtain an optimum purification result, intensive variables of state can be changed as a function of the concentration measured and, to obtain an optimum purification result, can be continuously adjusted to the process conditions prevailing at a given time.

Although specific examples of the present invention and its application are set forth herein, it is not intended that they are exhaustive or limiting of the invention. These illustrations and explanations are intended to acquaint others skilled in the art with the invention, its principles, and its practical application, so that others skilled in the art may adapt and apply the invention in its numerous forms, as may be best suited to the requirements of a particular use.

What is claimed is:

1. A method of purifying an electrolyte comprising:

bringing the electrolyte into contact with a first effective surface of a separating unit that is permeable to contaminants to be removed from the electrolyte in a purifying step;

bringing a purifying liquid into contact with a second effective surface of the separating unit during the purifying step;

maintaining a concentration level of contaminants in the purification liquid during the purification step which concentration level is lower than a concentration level of contaminants in the electrolyte and thereby maintains a contaminant driving force gradient between the electrolyte and the purifying liquid so contaminants transfer from the electrolyte into the purifying liquid.

2. The method of claim 1 comprising maintaining the concentration level of contaminants in the purifying liquid below a preselected concentration.

3. The method of claim 1 comprising maintaining the concentration level of contaminants in the purification liquid substantially constant.

4. The method of claim 1 comprising diluting the purifying liquid during said purifying.

5. The method of claim 1 comprising removing contaminants from the purifying liquid during said purifying.

6. The method of claim 5 wherein said removing contaminants from the purifying liquid comprises chemically binding and precipitating contaminants from the purifying liquid.

7. The method of claim 5 wherein said removing contaminants from the purifying liquid comprises filtering contaminants out of the purifying liquid.

8. The method of claim 5 wherein said removing contaminants from the purifying liquid comprises a method selected from among distillation, membrane distillation, freezing, absorption, and ion exchange.

9. The method of claim 1 comprising moving the electrolyte relative to the first effective surface of the separating unit.

10. The method of claim 1 comprising moving the purifying liquid relative to the second effective surface of the separating unit.

11. The method of claim 9 comprising moving the purifying liquid relative to the second effective surface of the separating unit.

12. The method of claim 11 comprising circulating the electrolyte and the purifying liquid in circuits that are fluidically independent of each other.

13. The method of claim 12 comprising moving the electrolyte and the purifying liquid countercurrently past each other.

14. The method of claim 1 comprising varying at least one intensive variable of state of at least one of the electrolyte and the purifying liquid as a function of the degree of purification desired.

15. The method of claim 14 wherein said intensive variables of state are selected from among temperature and pressure.

16. The method of claim 1 wherein the purifying liquid is selective for specific substances to be removed from the electrolyte.

17. The method of claim 1 wherein the electrolyte is employed in an electrolytic metal coating procedure and the contaminants which transfer from the electrolyte into the purifying liquid comprise chemicals used in preliminary treatments prior to the electrolytic metal coating procedure.

18. The method of claim 1 wherein the contaminants which transfer from the electrolyte into the purifying liquid comprise decomposition products from inorganic additives to the electrolyte.

19. The method of claim 1 wherein the contaminants which transfer from the electrolyte into the purifying liquid comprise decomposition products from organic additives to the electrolyte.

20. The method of claim 1 wherein the electrolyte is employed in an electroless metal deposition procedure in which nobler metal ions are deposited and less noble metal ions go into solution, and the contaminants which transfer from the electrolyte into the purifying liquid comprise said less noble metal ions.

21. A method of purifying an electrolyte comprising:

bringing the electrolyte into contact with a first effective surface of a separating unit that is permeable to contaminants to be removed from the electrolyte;

bringing a purifying liquid into contact with a second effective surface of the separating unit;

circulating the electrolyte and the purifying liquid in circuits that are fluidically independent of each other;

maintaining a concentration level of contaminants in the purifying liquid below a preselected level lower than a concentration level of contaminants in the electrolyte to maintain a contaminant driving force gradient between the electrolyte and the purifying liquid so contaminants transfer from the electrolyte into the purifying liquid; and removing contaminants from the purifying liquid by a method selected from among chemically binding and precipitating contaminants, filtering, distillation, membrane distillation, freezing, absorption, and ion exchange.

22. The method of claim 21 wherein the electrolyte is employed in an electrolytic metal coating procedure and the contaminants which transfer from the electrolyte into the purifying liquid comprise chemicals used in preliminary treatments prior to the electrolytic metal coating procedure.

23. The method of claim 21 wherein the contaminants which transfer from the electrolyte into the purifying liquid comprise decomposition products from inorganic additives to the electrolyte.

24. The method of claim 21 wherein the contaminants which transfer from the electrolyte into the purifying liquid comprise decomposition products from organic additives to the electrolyte.

25. The method of claim 21 wherein the electrolyte is employed in an electroless metal deposition procedure in which nobler metal ions are deposited and less noble metal ions go into solution, and the contaminants which transfer from the electrolyte into the purifying liquid comprise said less noble metal ions.

26. A method of purifying an electrolyte comprising:

bringing the electrolyte into contact with a first effective surface of a separating unit that is permeable to contaminants to be removed from the electrolyte;

bringing a purifying liquid into contact with a second effective surface of the separating unit;

circulating the electrolyte and the purifying liquid in circuits that are fluidically independent of each other; and maintaining a concentration level of contaminants in the purifying liquid below a preselected level lower than a concentration level of contaminants in the electrolyte by in-process dilution to maintain a contaminant driving force gradient between the electrolyte and the purifying liquid so contaminants transfer from the electrolyte into the purifying liquid.

27. The method of claim 26 comprising varying at least one variable selected from among temperature and pressure of at least one of the electrolyte and purifying liquid.

28. The method of claim 26 wherein the electrolyte is employed in an electrolytic metal coating procedure and the contaminants which transfer from the electrolyte into the purifying liquid comprise chemicals used in preliminary treatments prior to the electrolytic metal coating procedure.

29. The method of claim 26 wherein the contaminants which transfer from the electrolyte into the purifying liquid comprise decomposition products from inorganic additives to the electrolyte.

30. The method of claim 26 wherein the contaminants which transfer from the electrolyte into the purifying liquid comprise decomposition products from organic additives to the electrolyte.

31. The method of claim 26 wherein the electrolyte is employed in an electroless metal deposition procedure in which nobler metal ions are deposited and less noble metal ions go into solution, and the contaminants which transfer from the electrolyte into the purifying liquid comprise said less noble metal ions.

* * * * *